US005781976A

United States Patent [19]

Stuhlbacher et al.

[11] Patent Number: 5,781,976

[45] Date of Patent: Jul. 21, 1998

[54] METHOD OF AND APPARATUS FOR FABRICATING DIMENSIONALLY STABLE, CYLINDRICAL FILLER BODIES AND EXPANDED MATERIAL

[76] Inventors: Franz Stuhlbacher, Harterstrasse 26, 8053 Graz; Karl Heinz Zöhrer, Südtirolerplatz 10, 8020 Graz, both of Austria

[21] Appl. No.: 397,983

[22] Filed: Mar. 3, 1995

[30] Foreign Application Priority Data

Dec. 23, 1994 [AT] Austria ..... 2394/94

[51] Int. Cl.[6] ..... B21D 31/04

[52] U.S. Cl. ..... 29/6.1; 29/4.55; 29/17.1; 72/339

[58] Field of Search ..... 29/6.1, 4.51, 4.52, 29/4.55, 4.56, 17.1, 17.2; 72/324, 339

[56] References Cited

U.S. PATENT DOCUMENTS

| | | | |
|---|---|---|---|
| 2,829,733 | 4/1958 | Bartels et al. | 29/6.1 X |
| 4,613,054 | 9/1986 | Schrenk | 220/88 R |
| 4,621,397 | 11/1986 | Schrenk | 29/6.1 |
| 4,921,118 | 5/1990 | Gass | 29/6.1 X |
| 5,088,170 | 2/1992 | Späth | 29/6.1 |
| 5,207,756 | 5/1993 | Alhamad et al. | 29/6.1 |
| 5,247,822 | 9/1993 | Späth | 29/6.1 X |

FOREIGN PATENT DOCUMENTS

| | | |
|---|---|---|
| 749689 | 5/1944 | Germany . |
| 1590636 | 6/1981 | United Kingdom . |

*Primary Examiner*—Joseph M. Gorski

*Attorney, Agent, or Firm*—Jacobson, Price, Holman & Stern, PLLC

[57] ABSTRACT

A method of and an apparatus for the performance of the method for the fabrication of dimensionally stable, cylindrical filler bodies for increasing the surface area in receptacles, e.g. for the protection against explosive combustions, consisting of foil-like, preferably corrosion resistant material strips, especially consisting of metal, paper, paper board, synthetic material or a combination by coating, which allows a continous fabrication without requiring oscillating masses in the machine parts. The aim is reached by a foil strip which receives perforated cutting spots, staggered transverse to the conveying direction, the cutting spots stretched to the breadth and folded, lopped in pieces, cylindrically bent so as to be round, twisted at the ends and continously rolled into cylindrical bodies.

18 Claims, 4 Drawing Sheets

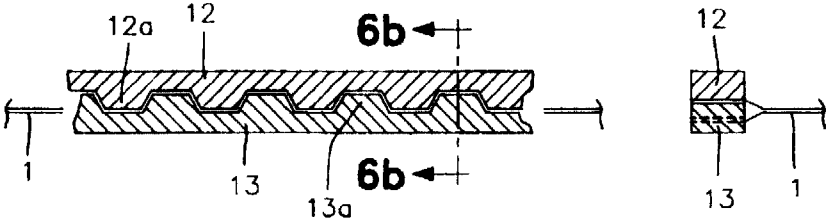
FIG. 6a
FIG. 6b
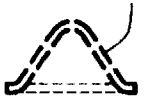
FIG. 7
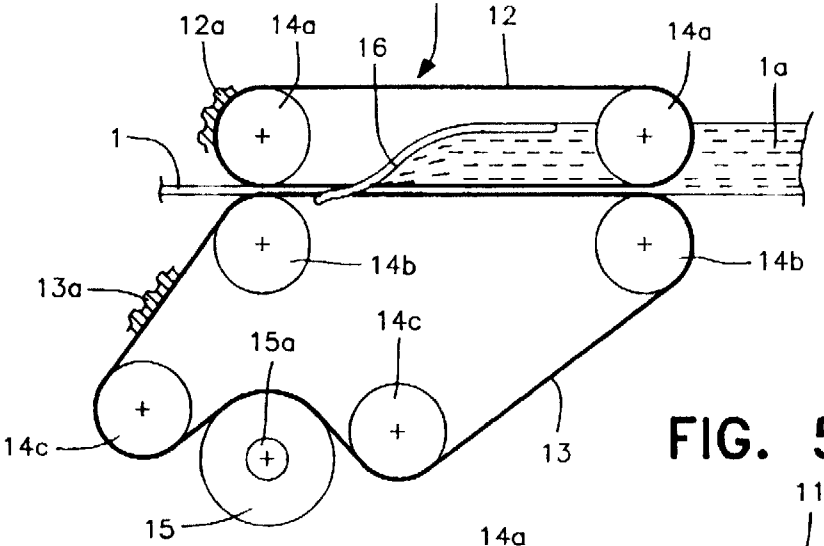
FIG. 4
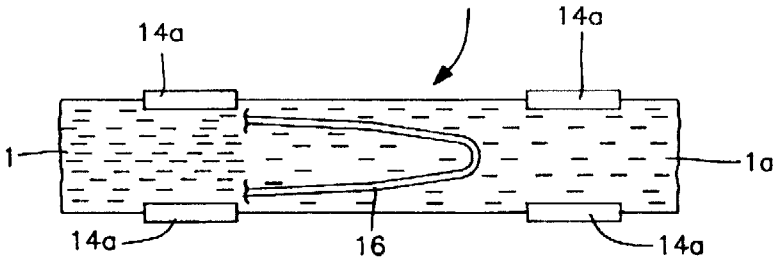
FIG. 5
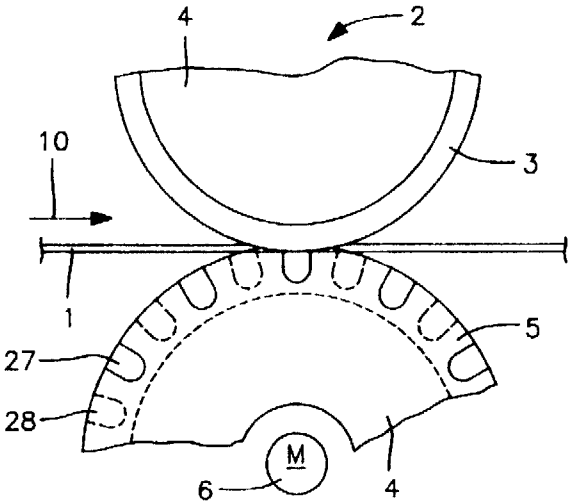
FIG. 2
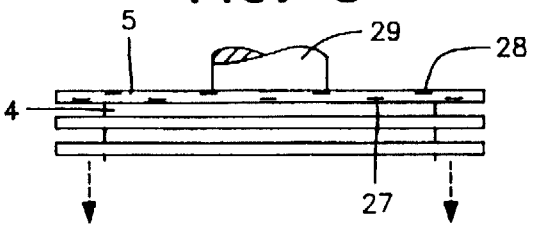
FIG. 3

METHOD OF AND APPARATUS FOR FABRICATING DIMENSIONALLY STABLE, CYLINDRICAL FILLER BODIES AND EXPANDED MATERIAL

BACKGROUND OF THE INVENTION

The invention relates to a method for the fabrication of dimensionally stable, cylindrical bodies, consisting of foil-like, preferably corrosion resistant material strips, especially consisting of metal, paper, paper board, synthetic material or a combination by coating, for increasing surface area in receptacles, as well as to an apparatus for the performance of the method.

The invention also relates to a method of preventing explosive combustions in fuel and gas tanks, to fuel and gas tanks protected against explosions and to a filler body for the installation into receptacles for liquid or gaseous combustibles.

Expanded metal is used for various purposes, e.g. to fill containers for combustible liquids or gases, in particular fuel and solvents, to prevent explosion-like combustions. At the beginning, the expanded metal used for these purposes has been made from very thin aluminum foil of a thickness of about 40 mm.

Apparatus for providing such expanded metal generally make use of knives arranged transversely to the conveying direction of the foil so as to provide small cuts transverse to the conveying direction. Stretching of the foil is obtained by operating the discharge unit of the apparatus at a speed higher than the speed of the feed unit so that the foil is stretched in the conveying direction.

The expanded metal obtained in such a manner has only limited dimensional stability so that the filling of such expanded metal of e.g. automobile gasoline tanks, balls together after a short period resulting in a loss of its explosion-preventing property.

It has therefore been proposed to produce expanded metal from thicker aluminum foils, e.g. with a thickness of 65 to 85 mm. However, as it turned out, the above-described apparatus could not be used with such aluminum foils as their thickness was too high to provide an expansion in the longitudinal direction of the foil provided with transverse cuts simply by increasing the discharge speed relative to the supply speed.

From the German patent 749 689 an apparatus for cutting off wire-like strips from a foil is known in which a cutting unit includes a stationary knife edge and a knife which is designed as a milling cutter and is provided with cutting edges. The continuous cuts as provided by the unit extend perpendicular to the conveying direction of the foil.

The British patent 1 590 636 discloses an apparatus for profiling metal foils including a pair of rollers having a distance from each other which is smaller than the thickness of the foil to be profiled. In addition, the rollers have a length which is smaller than the width of the foil so that a partial expansion of the foil is obtained in the longitudinal direction during its passage through the pair of rollers. Arranged downstream of the apparatus is a further pair of profiled rollers which provides a profile transverse to the longitudinal direction of the foil in the respective expanded area.

The disadvantage of incorporating a block of the expanded aluminum foil in a fuel receptacle or tank, however, is that the dimensions of the expanded metal body make it difficult to remove the body even with deformation and distortion thereof or make it impossible to remove the body from the tank. Such a removal of the filler from the tank may become necessary or desirable for cleaning of the tank or for repair thereof.

In addition, it has been impossible to introduce conventional tank filler bodies of expanded metal into already fabricated fuel tanks or receptacles, also because of the dimensional factors mentioned previously.

U.S. Pat. No. 4,613,054 discloses a known apparatus for the shaping of dimensionally stable, bale shaped bodies out of thin-fibrous material. At this, the thin fibrous or stretched metal to be formed is furnished in a bunched condition to a cutting and pressing device, wherein a guiding device and a clamping arrangement is added to the cutting device which is back and forth movable to the conveying direction of the bunched metal material. The cutting device consists of an opposite-direction-moving cutter, placed transverse to the conveying direction of the metal material. The blades are formed by round-holes, through which the metal material is led and then cut off. By pressurization and forming, the form body is created. Clamp segments are formed by hydraulic moveable clamp forcers.

U.S. Pat. No. 4,621,397 discloses a known apparatus for producing expanded metal, wherein the foil first of all receives intermittent cuts, is led into roll pairs which are twisted by toothed belts and is gripped at its borders in the intermeshing teeth. A primary shoe serves to stretch the slit cut foil to the breadth. The primary shoe is placed as a fixed part in the stretching device and presents an adjusted shaping at the contact point with the expanded foil.

It is disadvantageous that the first kind of appliance consists predominantly of oscillating parts—like the cutting device and the gripping arrangement—and that a continuous development of shaping is not given. The production of such form bodies is time-consuming and uneconomical. In the further mentioned case, it is disadvantageous that these primary shoes respectively are fixed parts over which the expanded material is gliding, leaving particles of dust caused by abrasion which are dragged along as impurity. Moreover, a homogenous extension is not possible.

A further resulting disadvantage is that the received filler bodies are hollow or concave with a limited stability which allows an easy compression of the same.

SUMMARY OF THE INVENTION

The principal object of this invention is to provide a filler body for increasing surface area in receptacles in order to prevent explosive combustion in these equipped receptacles when filled with combustible liquids or gases.

Proceeding from the state of the art mentioned-above, for this invention, the task was to develop a method which allows a continuous production of expanded material without oscillating masses in the machine parts. Further, no fixed and abradant elements should be contained in order to guarantee an exact extension over the total breadth of the expanded material. According to the invention, this aim is reached by a foil strip, which receives perforated cutting spots, staggered transverse to the conveying direction, the cutting spots stretched to the breadth and folded, lopped in pieces, cylindrically bent round, twisted at the ends and continuously rolled into cylindrical form bodies.

Since an economic production of huge amounts of cylindrical bodies formed of expanded material is therefore possible and these can fill gas or fuel tanks, explosive combustion can be prevented.

So the general object of the invention is to overcome drawbacks and disadvantages of prior art systems while being able to achieve production even more economically.

The invention relates to a method of and an apparatus for the performance of the method for the fabrication of dimensionally stable, cylindrical bodies, consisting of foil-like, preferably corrosion resistant material strips, especially consisting of metal, paper, paper board, synthetic material or a combination by coating, which allows a continuous fabrication without having oscillating masses in the machine parts.

The aim is reached by a foil strip which receives perforated cutting spots, staggered transverse to the conveying direction, the cutting spots stretched to the breadth and folded, lopped in pieces, cylindrically bent round, twisted at the ends and continuously rolled into cylindrical form bodies.

This method for the production of form bodies in huge amounts is, after a further formation, used advantageously, if the foil strip gets an extension of preferably threefold breadth, the same is folded to a double, preferably threefold formed body, wherein the lopped, multilayered formed bodies, as cylindrical parts, have a length which corresponds to double the diameter.

Further it is advantageous, if for the performance of the method, an arrangement is designated, presenting a cutting, stretching and rolling device, the cutting device consisting of superimposed rollers, on the one hand consisting of discoid, even top cutting knives and washers machined to close tolerances and on the other hand of further bottom cutting knives, which present alternating on the side in the cutting region recesses and the distances to these recesses form the cut length.

It is additionally advantageous, if the stretching device consists of superimposed deflection roller pairs, the driving elements, preferably twisted by toothed belts having teeth directed radially to the outside, are looped, and these teeth grippingly retain the borders of the foil strip during progressive movement, wherein a primary shoe, e.g. a bow-shaped tension spring or a roll, movable on a spindle, slewable over a swivel fixed pivot bracket, located between the deflection roller pairs foil lengthwise, stretches the perforated foil strip in C-form to the breadth.

According to another advantageous embodiment, the roll consists of at least two roll halves, preferably four roll halves, with inclining diameter to the outside from the roll middle and independently rotatable with respect to one another and axially movable on a spindle. The rolls or roll halves present on the running surface, turned to the stretch material, an approximately axially directed profiling and/or contains a glide-favoring coating, wherein the roll halves are formed as concave shells or wire bodies, while a concave shell contains a connection element, e.g. a ring or webs, which allows a contraction in the middle part of the stretch material.

A further advantage is achieved if the top toothed belt, being connected by meshing with the bottom toothed belt is drivable through the bottom deflection rollers with the intermediary driving pinion and motor, wherein the roll or the roll halves are running on bearings as loose rolls and are movable with the movement of the stretch material strip frictionally engaged or if according to the solidity of the expanded material a synchronous actuation is intended therefor.

It is also advantageous, if in the rolling device, the foil strip is led through the nozzle overlapping, preferably threefold, and deflected over a needle roller to a pair of knives, e.g. an unremovable top knife and a bottom knife, fixed in a drum, rotating with it and lopping the foil strip in equal pieces.

Further, it is advantageous if the rotating drum has a recess, out of which the material is directable radially to the outside, with the shell forming an annulus, the annulus progressively reducing in size by virtue of a rolling frame arranged in helix form at the generated surface of the drum, wherein the cylindrical lopped pieces are twisted by a baffle e.g. a pressing cloth or like narrowing means and cylindrically rolled by the rough surface of the annulus wall.

In this way, the present invention achieves use of this method for the fabrication of cylindrical form bodies, and a continuous development is guaranteed and a production of huge amounts of these form bodies is possible using simple means.

It is further achieved, that the cylindrical filling bodies have more stability and cause less loss of volume than the mentioned former filler bodies according to U.S. Pat. No. 4,613,054 which are hollow and concave and easily compressible.

BRIEF DESCRIPTION OF THE DRAWINGS

By means of an example of operation, the invention will be illustrated in the figures as follows:

FIG. 2 schematically illustrates a cutting device according to the invention.

FIG. 3 schematically illustrates a horizontal view of the cutting device.

FIG. 4 schematically illustrates a stretching device according to the invention.

FIG. 5 schematically illustrates a horizontal view of a primary shoe.

FIGS. 6*a* and 6*b* schematically illustrate formation of the toothed belt.

FIG. 7 schematically illustrates a profile foil strip.

DESCRIPTION OF THE PREFERRED EMBODIMENTS

Figure 1:
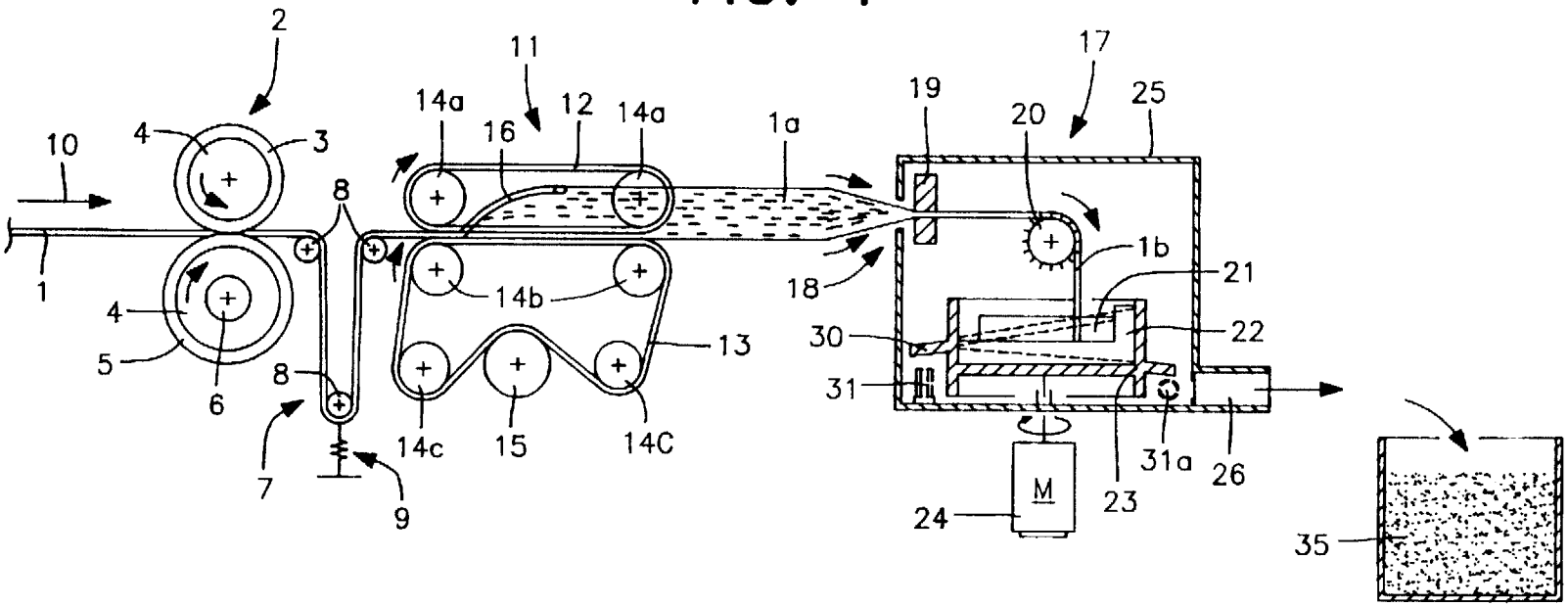
FIG. 1 schematically illustrates the apparatus of the present invention.

As FIG. 1 shows, the process of fabrication of dimensionally stable cylindrical bodies is schematically projected by the performance of the process. The foil strip 1 is led in the conveying direction 10 to the cutting device 2. This cutting device includes superimposed cutting knives 3 with washers machined to close tolerances 4 and the underneath cutting knives 5, forming a roller, consisting of several layers and set on a shaft. Further, on the same shaft, there is fixed the driving motor 6 in the bottom part of the underneath cutting knives 5. The cutting knives 5 are therefore driven and by adhesion traction, the top cutting knives are also moved.

At the connection of the cutting device 2, there is designated a fastening device 7. This includes deflection rollers 8, arranged in such manner that the foil strip 1 is drawn downward. The foil strip 1 gets the necessary initial tension from a tensioning spring 9.

After that, the stretching device 11 is connected, which fixes the foil strip 1 on both sides approximately in the middle of the deflection rollers 14*a*. Over the top deflection rollers 14*a*, a tooth belt 12 is twisted at both sides. The bottom deflection rollers 14*b* are placed at the same spot as the top deflection rollers 14*a*, however, on the rear side of the foil strip 1. Moreover, additional deflection rollers 14*c* serve to set the driving motor 15*a* between the bottom deflection rollers 14*c*. The toothed belts 12 and 13 have radially to the outside directed teeth. As the motor 15*a* is placed between the lowest deflection rollers 14*c*, the motor 15*a*, actually its driving pinion 15, can intermesh in the toothed belt 13, because the angle of belt wrap is big enough. The top toothed belt 12 now runs with the bottom toothed belt 13, and the borders of the foil strip 1 are placed intermediately. The motor 15*a* therefore drives the bottom toothed belt 13, the top toothed belt 12 and the intermediately gripped borders of the foil strip 1.

After the foil strip 1 has been perforated in the cutting device 2, the foil strip 1 is led over a tension spring 16 or a similar stretching element as a primary shoe under retention of the border fixing so that the foil strip 1 will be expanded to the preferably threefold breadth to the foil strip 1*a*. The c-shaped expanded foil strip 1*a* leaves the stretching device 11.

The rolling device 17 consists of a shell 25 which has an opening 18. Here the expanded foil strip comes to the nozzle 19. This effects a rolling or folding e.g. to a three-layered bundle. A driven needle roll 20 carries out the transport of the now bundled foil 1*b* and directs the same to a drum 23. Fixed to the shell, a top knife 21 is attached, while at the rotating drum 23 the bottom knife 22 is fixed. On the outside of the drum 23, a helix shaped projecting rolling web 30 is provided and the cylindrical lopped pieces 31 are formed to cylindrical bodies 31*a*. Over the ejection slot 26, the material gets into the collecting box 35.

In FIG. 2, the formation and mode of operation of the cutting device 2 is shown in more detail. The top cutting knife 3 is formed as an even disc and smaller in diameter, while the washers 4 are fixed in alternating order on a spindle 29. The bottom cutting knife 5 is in the same way provided with washers 4 of the same width, wherein both cutting knives 3, 5 are overlapping, i.e. forming a pair of staggered knives. The bottom cutting knife 5 now has the same number of recesses 27, 28 on both sides, proportionally distributed on the perimeter of the cutting edge.

FIG. 3 shows the horizontal projection on the cutting device 2, particularly on the cutting knives 5. The recesses 27, 28, which are staggered on both sides, can be seen here. The number of cutting knives 5 and washers 4 corresponds at least to the breadth of the foil strip 1. These cutting knives 5 are mounted on the spindle 29. The same refers to the top cutting knives 3.

FIG. 4 illustrates the stretching device 11. Top deflection rollers 14*a* and bottom deflection rollers 14*b* are twisted by toothed belts 12, 13. At this point the teeth 12*a*, 13*a* are directed to the outside. The bottom toothed belt 13 is somewhat longer, so that further deflection rollers 14*c* can be installed. Further, there is a driving pinion 15 with a motor 15*a* placed between the deflection rollers 14*c*. In the clearance zone between the deflection rollers 14*a*, 14*b* and the following deflection rollers in the conveying direction, an additional primary shoe 16, as e.g. a spring bow or the like is placed pointing upward with a bowed end. The vertical axle bases of the deflection rollers 14*a*, 14*b* are so designed that the toothed belts 12, 13 are permanently in gear, fixing the borders of the foil strip 1. If the motor 15*a* is now set in motion, the foil strip 1 moves over the stretching device 16 and such expands the foil strip 1*a* to an approximately threefold breadth.

FIG. 5 shows the horizontal extent of the stretching device 11. The wheel gauge of the deflection rollers 14*a*, 14*b* is dimensioned so that the foil strip 1 is only gripped at the borders. The primary shoe 16 is here designed as a spring bow.

FIGS. 6*a* and 6*b* show a clipping of the toothed belts 12, 13 with the intermediary foil strip 1. In this connection it is essential that the lateral faces of the teeth have an angle of e.g. 60° to guarantee a tight gripping of the foil strip 1.

FIG. 7 shows in profile the expanded foil strip 1*a*, which now has achieved a c-shaped configuration having a threefold breadth compared to the former foil strip 1.

Figure 8:
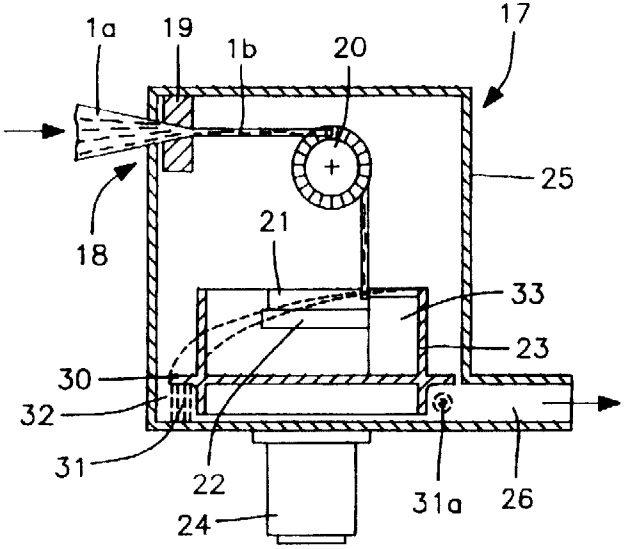
FIG. 8 schematically illustrates a rolling device.

In FIG. 8 the rolling device is specified. At the top section of the shell 25, there is an opening 18, and in back of it, the nozzle 19. Here the foil strip 1*a* is rolled up to become an approximately three-layered foil strip 1*b*. With the aid of a needle roller 20 with actuation, the advance of the foil strip 1*b* follows and is deflected downward by 90°. In the bottom section, a drum 23 is placed which can be rotated by a motor 24. Fixed to the shell there is a top knife 21 while the bottom knife is fixed with the rotating drum 23. At the outside of the drum, a helix shaped upwardly pointing rolling web 30 is fixed. Together, the rolling web 30, drum 23, and shell 25 define an annulus 32 in which the lopped pieces 31 are picked up and rolled up cylindrically. As the looped pieces are rolled, the web 30 progressively compresses the ends of the lopped pieces. The lopped pieces 31 are approximately double of the diameter in length. The annulus 32 is designed so as to narrow by degree, so that the lopped pieces 31 take on a cylindrical shape and are put out through the ejection slot 26.

Figure 9:
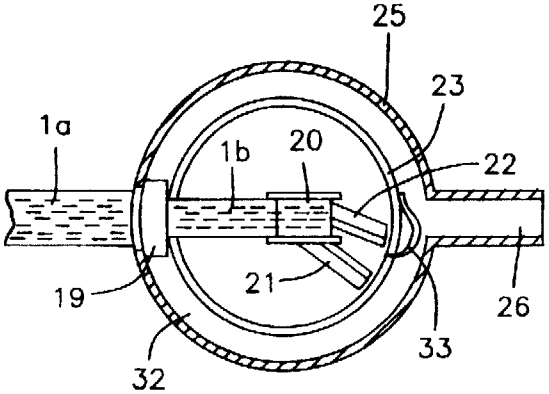
FIG. 9 schematically illustrates a horizontal view of the rolling device.

FIG. 9 shows the horizontal extent of the rolling device 17. The foil strip 1*a* is fed over the nozzle 19 into the shell 25 as foil strip 1*b*, deflected downward by the needle roller 20 and supplied to the cutting knives 21, 22. With the aid of the pressing cloth 33, a baffle or like narrowing means, which projects from the drum 23 into the annulus 32, the lopped pieces 31 are rolled up. The output ensues through the ejection slot 26.

Figure 10:
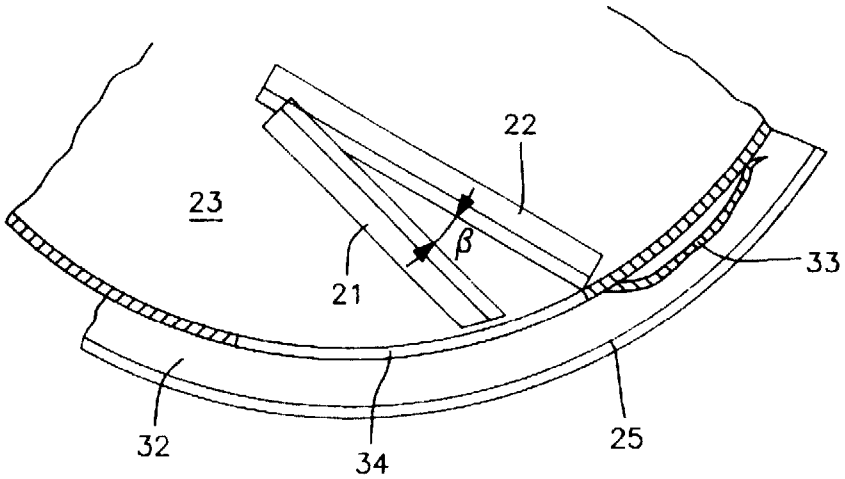
FIG. 10 schematically illustrates an arrangement of lopping knives.

FIG. 10 shows, in an enlarged manner, a clipping of the drum 23, particularly the position of the shell-fixed top knife 21 and the placement of the bottom knife 22 which rotates with the drum 23. These are placed in a vertex angle overlapping at the ends to obtain an efficient shear effect. In the drum 23, there is an additional recess 34 which conveys the lopped pieces 31 into the annulus 32. With the aid of movable baffles, e.g. a pressing cloth or like narrowing means, a rolling motion is imparted upon the lopped pieces 31. The lopped pieces 31 coming out of the drum 23 lay themselves on the inner surface of the shell 25. Favored by the rough surface of the wall of the annulus 32, they are taken by the baffle at the top and rolled up. At this point, the ends of the lopped pieces 31 are twisted, i.e compressed and finally rolled up to quadratic cylinders. By virtue of the narrowing slot height, a rolling of the coiled lopped pieces 31 ensues between the moving helix surfaces and the shell bottom around an axis, vertical to the drum axis, by which the coil is formed into a quadratic cylinder.

Figure 11:
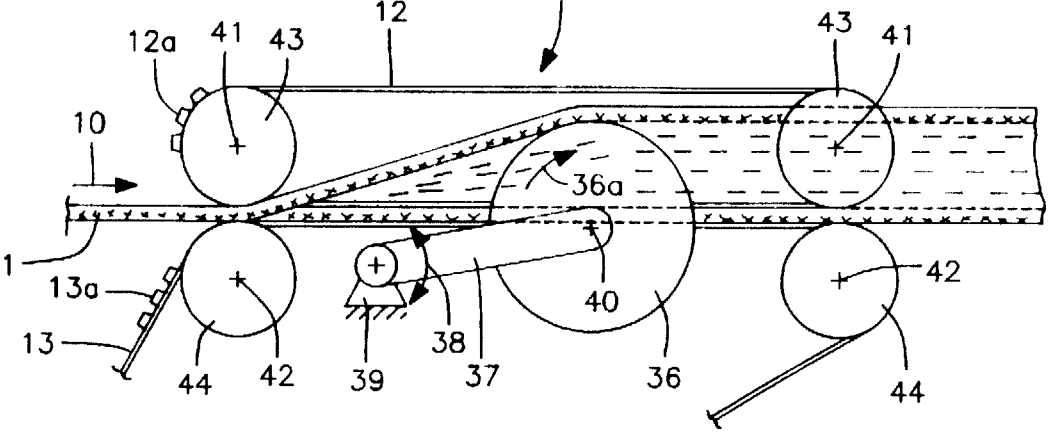
FIG. 11 is a side view of a stretching device.

A further formation of the stretching device is illustrated in the side view of FIG. 11. The roll 36 is movable on the spindle 40, slewable over a swivel fixed pivot bracket 37. On the other end, the pivot bracket 37 is supported by a pillow block 39 and allows in a certain section according to arrow 38 a horizontal swing around the center of motion of the pillow block 39. Further, respective deflection rollers 43, 44 are placed before and after the roll 36, wherein around the top deflection rollers 43 a toothed belt 12 is twisted. Likewise, there is also a toothed belt 13 twisted around the bottom deflection rollers 44. Both toothed belts 12, 13 respectively have teeth 12*a*, 13*a* directed to the outside and are permanently in gear between the axes 41, 42 and the deflection rollers 43, 44. The axis distances between the axes 41, 42 in the vertical direction are chosen such that the expanded material 1*a* is gripped at the borders. By actuation, the bottom toothed belt 13 (in FIG. 11 to the right side) is set in motion, wherein the top toothed belt 12 is also moved by gearing. Likewise, the stretch material 1 is transported according to arrow 10. If the stretch material 1 is now moved forward and at first gripped between the deflection rollers 43, 44 by the toothed belts 12, 13, it must be led over a baffle, which is represented by roll 36. Consequently, the stretch material 1 is expanded into breadth and brought out of the stretching device 11. The toothed belts 12, 13 consist of webbed plastic or rubber. However, if a stretch material e.g. out of stainless metal is chosen, it is important to use toothed chains instead of toothed belts, which additionally have clamps on each chain link. Since such chains are commercially known, a detailed description is not necessary. It is essential that the loose roll 36, according to arrow 36*a* be turned synchronously with the stretch material 1 and be frictionally engaged without relative movement. If the friction should not be sufficient, a synchronously running actuation can also be used.

Figure 12:
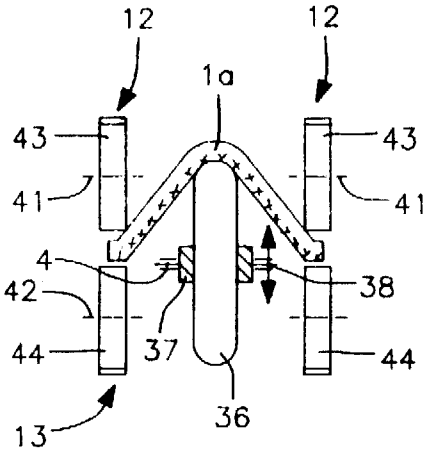
FIG. 12 is a cross-section of the apparatus of the present invention.

FIG. 12 shows the cross section of the stretching device specified in FIG. 11. The roll 36 is movable on the spindle 40, and is slewable over a swivel fixed pivot bracket 37 according to arrow 38. Collateral are the deflection rollers 43, 44, which are fixed movably around their axes 41, 42. Around the deflection rollers 43, 44 the toothed belts 12, 13 are running. The stretching material is gripped at the borders intermediately. Here it can be seen that the stretching material 1 is led over the roll 36 and gets its lateral expansion by that.

Figure 13:
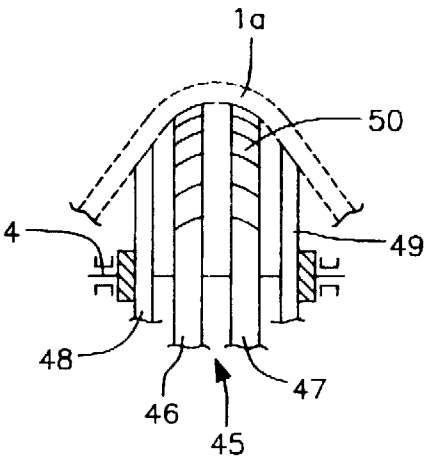
FIG. 13 illustrates formation of the roll.

FIG. 13 shows the further formation of roll 36 as a separated roll 45, which ensures that the stretch material 1*a* is stretched homogeneously over the whole breadth. Here it is advantageous if the roll 36 consists of roll halves 46, 47, which furthermore are axially movable on the spindle 40. By that, the expansion can be prescribed exactly, which is of importance to the quality of the product. It is further of advantage, to place additional smaller roller halves 48, 49 collateral to the roller halves 46, 47 to obtain exact expansion and support also in the side section directed to the gripping spot. Also these roll halves 48, 49 are axially movable on the spindle 40. The roll 36, or specifically the roll halves 46, 47 and 48, 49 present a profiling 50 on the running surface, turned toward the expanded material 1*a* and/or contains a glide-favoring coating. It is thereby guaranteed that the expanded material 1*a* results in a homogenous expansion pattern.

Figure 14:
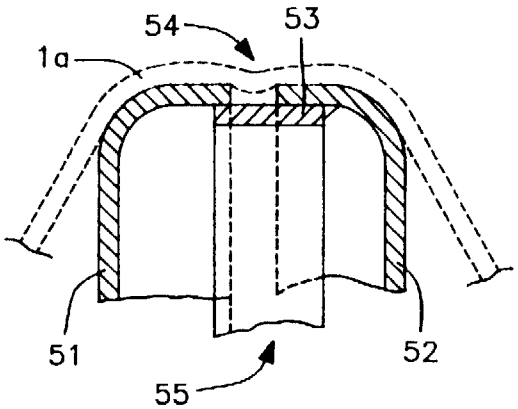
FIG. 14 illustrates further formation of the roll.

Finally, a further variant is illustrated in FIG. 14, which contains a loose roll 55, which is formed out of concave shells 51, 52 or wire bodies. At a concave shell 51, 52, a connection element 53 is provided in the form of a ring or several webs and which is welded on the same, while the connection element 53 is axially movable as guidance in the concave shell 51. By that, it is possible to exercise an influence on the stretching of the expanded material 1*a* and to force a contraction. That is important in that for the pleating of the expanded material 1*a*, a favorable initial point is obtained. By using this formation of the stretching device, it is possible to achieve over the total breadth of the stretch material a homogenous expansion which is decisive for the further processing to quadratic cylinders for subsequent installation into gas or fuel tanks or other vessels. A continuous fabrication of the form bodies in huge amounts without oscillating masses of the machine parts is therefore possible.

We claim:

1. An apparatus for fabricating dimensional stable cylindrical bodies of thin material strips, comprising:

means for forming slits through a thin strip of material, which slits extend longitudinally of said strip and which are staggered with respect to one another in a transverse direction of said strip;

means, downstream of said means for forming slits, for expanding said strip of material in said transverse direction to a desired breadth;

means, downstream of said means for expanding, for folding said strip of material in said transverse direction, for lopping said strip of material into pieces after it has been folded, and for cylindrically compacting lopped pieces of the strip of material in such a manner that the lopped pieces are rolled into cylindrical bodies; and conveying means for conveying said strip of material through said means for forming slits, means for expanding and means for folding, lopping and compacting; wherein said means for forming slits includes a first set of cutting discs separated from one another by a washer such that a space exists between every two immediately adjacent cutting discs, and a second set of cutting discs separated from one another by a washer such that a space exists between every two immediately adjacent cutting discs, wherein said cutting discs of said first set are individually received within said spaces of said second set and said cutting discs of said second set are individually received within said spaces of said first set, and wherein each cutting disc of said second set has a first plurality of spaced recesses on one side of said disc extending inwardly from a periphery thereof and around the entire periphery thereof, and a second plurality of spaced recesses on an opposite side of said disc extending inwardly from a periphery thereof and around the entire periphery thereof, such that along the entire periphery of said disc the following pattern is established and repeated, recess of first plurality, recess of second plurality, recess of first plurality, recess of second plurality.

2. The apparatus according to claim 1 wherein said means for expanding includes four roller pairs, an endless toothed belt wrapped around each said roller pair, and a primary shoe located longitudinally between the rollers of each pair and transversely between said toothed belts, wherein as said strip of material is conveyed by said means for conveying, said slits along edges of said strip are engaged by said teeth of said toothed belts, and said strip is deflected over said primary shoe while said teeth maintain engagement with said slits, such that said strip is expanded into a general C-shaped form.

3. The apparatus of claim 2, wherein said primary shoe comprises a bow-shaped tension spring.

4. The apparatus according to claim 2, wherein a top one of the belts meshes with and is drivable by a bottom one of the belts via bottom deflection rollers, an intermediary driving pinion, and a motor.

5. The apparatus of claim 2, wherein said primary shoe comprises a pillow block, a pivot bracket pivotally mounted to said pillow block, and a roll rotatably mounted via a spindle to said pivot bracket, said roll being slewable along with said pivot bracket.

6. The apparatus according to claim 5, wherein the roll includes at least two roll halves, said roll having a diameter which is greatest in a middle region of the roll and which progressively decreases toward longitudinal ends of the roll, said roll halves being independently rotatable with respect to one another and axially movable on the spindle.

7. The apparatus of claim 6, wherein the roll includes substantially axially extending profiling directed toward said material strip.

8. The apparatus of claim 6, wherein said roll includes a glide-favoring coating.

9. The apparatus of claim 6, wherein the roll halves are formed as concave shells containing a connection element which allows contraction in a middle part of the material strip.

10. The apparatus of claim 9, wherein said connection element comprises a ring.

11. The apparatus of claim 9, wherein said connection element comprises webs.

12. The apparatus of claim 6, wherein the roll halves are formed as wire bodies.

13. The apparatus of claim 6, wherein the roll halves run on bearings as loose roll halves and are movable with the movement of the material strip, after expansion, while said material strip is frictionally engaged.

14. The apparatus of claim 6, wherein the roll halves run on bearings which provide synchronous rotation of the roll halves.

15. The apparatus according to claim 1, wherein said means for folding, lopping, and compacting includes a nozzle which receives and folds said strip, a pair of knives which lop the strip of material into equal pieces, and a needle roller that deflects the strip of material from said nozzle to said pair of knives.

16. The apparatus of claim 15, wherein said nozzle is arranged so as to fold said material strip into a triple overlapping configuration.

17. The apparatus of claim 15, wherein said pair of knives include an unremovable top knife and a bottom knife, fixed in a drum, and rotatable with the drum.

18. The apparatus according to claim 15, wherein said means for folding, lopping and compacting further includes a rotating drum having a recess, a helix arranged on an outside surface of said drum, and a shell surrounding said drum, wherein lopped pieces of said strip of material pass through said recess and beneath said helix, such that as said drum rotates said helix cooperates with said shell to compress said lopped piece into cylindrical bodies.

* * * * *